US006076275A

United States Patent [19]

Kuno et al.

[11] Patent Number: 6,076,275

[45] Date of Patent: Jun. 20, 2000

[54] CONTINUOUS DRYING APPARATUS FOR POROUS WEB

[75] Inventors: Hiroaki Kuno; Akira Sanada; Susumu Taniguchi; Younosuke Hoshi, all of Hiroshima-ken, Japan

[73] Assignee: Mitsubishi Heavy Industries, Ltd., Tokyo, Japan

[21] Appl. No.: 09/109,906

[22] Filed: Jul. 2, 1998

[30] Foreign Application Priority Data

Jul. 7, 1997 [JP] Japan ..... 9-181545

[51] Int. Cl.[7] ..... D06F 58/16

[52] U.S. Cl. ..... 34/117; 34/120

[58] Field of Search ..... 34/117, 120

[56] References Cited

U.S. PATENT DOCUMENTS

| | | | |
|---|---|---|---|
| 3,783,097 | 1/1974 | Justus | 162/358 |
| 4,461,095 | 7/1984 | Lehtinen | 34/41 |
| 4,464,226 | 8/1984 | Karvinen | 162/358 |
| 5,152,076 | 10/1992 | Virta et al. | 34/16 |

FOREIGN PATENT DOCUMENTS

| | | |
|---|---|---|
| 0 258 169 | 3/1988 | European Pat. Off. . |
| 1-56198 | 11/1989 | Japan . |

*Primary Examiner*—Henry Bennett
*Assistant Examiner*—Malik N. Drake
*Attorney, Agent, or Firm*—Armstrong, Westerman, Hattori, McLeland & Naughton

[57] ABSTRACT

The present invention is directed to a technique on a continuous drying apparatus for porous web, which comprises a heating cylinder, an impermeable drying band impermeable to air and water, coming into contact with and supporting the surface on the side having no contact with the heating cylinder of the porous web, and a plurality of water lubricating shoe members arranged around the heating cylinder apart a desired distance from the external side of the impermeable drying band, for forming a water screen flow between them and the external surface of the impermeable drying band, whereby an effective drying of the porous web is achieved.

8 Claims, 7 Drawing Sheets

(1) ROTARY PLUNGER TYPE (7.5kw)
(2) ROTARY PLUNGER TYPE (2.2kw)
(3) ROTARY PLUNGER TYPE (0.75kw)
(4) SLIDING VANE TYPE (0.4kw)

(1) MECHANICAL BOOSTER (2.2kw) + OIL-SEALED ROTARY VACUUM PUMP(7.5kw)

(2) MECHANICAL BOOSTER (2.2kw) + OIL-SEALED ROTARY VACUUM PUMP (2.2kw)

(3) MECHANICAL BOOSTER (0.75kw) + OIL-SEALED ROTARY VACUUM PUMP(2.2kw)

CONTINUOUS DRYING APPARATUS FOR POROUS WEB

BACKGROUND OF THE INVENTION

1. Field of the Invention

The present invention relates to a continuous drying apparatus for porous web, suitable for use as a pressure drying apparatus applied to a dryer part in a paper machine or as a pressure drying apparatus for porous web other than paper (for example, a sheet drying apparatus).

2. Description of the Related Art

FIG. 4 is a schematic diagram of a conventional continuous drying apparatus for porous web (cited from Japanese Patent Publication No. HEI 1-56198). In this apparatus, as shown in FIG. 4, paper or other porous web 3 (such as a sheet) to be dried and a drying band (a dry felt or wire) 4 for supporting the porous web 3, together with an auxiliary wire 5, enter an air removal chamber 6 which is continuously exhausted of air 7 by a suction pump and are subjected to air removal processing to have a satisfactory heat conductivity, after which they pass through between two surface elements 1 and 8 impermeable to air.

In this case, the surface elements 1 and 8 embrace the porous web 3 over the entire width thereof in such a manner that the surface element 1 in contact with the porous web 3 is heated by a heating medium within a heating space 2. Furthermore, the surface element 8 in contact with the drying band 4 is cooled by a fluid flowing through a cooling space 11 so that water vaporized from the porous web 3 can be condensed within the drying band 4.

After the separation from the surface elements 1 and 8, the drying band 4 is further separated from the porous web 3 so that the condensed water within the drying band 4 is removed in a suction box 17.

Furthermore, a cooling space 11 is sealed against a hood 13 supported by a support beam 14 and against rolls 9 and 10 by means of appropriate seals 16*a* and 16*b*, respectively, with a cooling liquid flowing through the cooling space 11 being fed from a liquid supply port 12 and discharged from a liquid discharge port 15.

In this manner, the porous web 3 is embraced by the surface elements 1 and 8 and are externally heated and cooled to remove water (moisture) contained therewithin.

However, since the cooling liquid flowing through the cooling space 11 is sealed by the rolls 9 and 10 in such a conventional continuous drying apparatus for porous web, the cooling liquid will adhere to the surfaces of the rolls 9 and 10, resulting in a slip of the surface element 8 on rolls 9 and 10. In the case of high speed running in particular, this slip becomes significant resulting in a remarkable abrasion and extreme meandering of the drying band 4, obstructing the steady running.

Also, the support beam 14 seals between the hood 13 defining the cooling space 11 and the various members and constitutes a cooling space from the viewpoint of pressure resistant structure, so that the entire size is enlarged, taking a lot of labor and time for the replacement of the surface element 8 and the drying band 4. More specifically, since the surface element 8 and the drying band 4 have an endless structure, they must be slid in the direction orthogonal to the plane of FIG. 4 for the replacement.

Moreover, in the continuous drying apparatus for porous web of FIG. 4, a closed space is formed upstream of the cooling space 11 (more specifically, the region extending from the liquid supply port 12 up to the liquid discharge port 15) serving as a drying section, and the air removal chamber 6 is provided in the closed space to continuously discharge the air 7 therewithin by means of the suction pump, for executing the air removal processing. However, in order to increase the drying speed, the pressure within the closed space must be kept at about 1 Torr or below, so there is also a problem that the exhaust speed of the suction pump becomes too high.

Following is a test calculation of the required exhaust speed by way of example.

(1) Conditions:

a. drying band; width B×thickness t×void volume $\Phi=6^{m}\times 0.003^{m}\times 0.3$ b. line speed u=1200 m/min c. degree of vacuum $P_1$=1 Torr (2) Calculation of Exhaust Velocity $$S=Bt\Phi u\times 760/P=6\times 0.003\times 0.3\times 1200\times 760/1$$

$$=4.92\times 10^{3}\,m^{3}/min=4.92\times 10^{6}\ l/min\ (liter/min)$$

where S: exhaust speed ($m^3$/min)

The suction pump can be an oil-sealed rotary vacuum pump or a mechanical booster pump from the conditions on the degree of vacuum. These characteristics are shown in FIGS. 5 and 6.

As is apparent from FIGS. 5 and 6, even in the condition (the condition (1) in both FIGS. 5 and 6) maximizing the required exhaust speed (l/min), it result in the vicinity of $1\times 10^{4}$ l/min at 1 Torr in the degree of vacuum (pressure P1), in other words, the result ($4.92\times 10^{6}$ l/min) of the above calculation is about 100 times larger than these general specifications, which will be impractical.

Furthermore, FIG. 7 illustrates an influence of air (uncondensed gas) on the condensation heat transfer rate of vapor. As is clear from FIG. 7, accordingly as the air content is increased, diffusion of the vapor is blocked, resulting in a reduction in the condensation heat transfer rate. The range of the air content allowing a neglect of such an influence of the air is of the order of 0.002 kg (air)/kg (vapor), with the air content being 0.001 $m^3$ (air)/$m^3$ (vapor) in terms of volume ratio. That is, air partial pressure of 1 Torr or below corresponds to total pressure 1000 Torr of vapor (including air).

SUMMARY OF THE INVENTION

The present invention was conceived in view of the above problems. It is therefore the object of the present invention to provide a continuous drying apparatus for porous web, ensuring effective drying of the porous web through the contrivance of a member for pressing the porous web against a heating cylinder.

A continuous drying apparatus for porous web in accordance with the present invention comprises a heating cylinder having a peripheral surface brought into contact with porous web for heating the porous web; an impermeable drying band impermeable to air and water, coming into contact with and supporting the surface on the side having no contact with the heating cylinder of the porous web; and a plurality of water lubricating shoe members arranged around the heating cylinder apart a desired distance from the external surface of the impermeable drying band, for forming a water film flow between the shoe members and the external surface of the impermeable drying band.

Also, the above water lubricating shoe members each include a shoe for forming a water film flow between the shoe and the external surface of the impermeable drying band, and a hydraulic apparatus for pressing the shoe via the water film flow against the heating cylinder.

Thus, according to the continuous drying apparatus for porous web of the present invention, the porous web running on the heating cylinder is pressed by the plurality of water lubricating shoe members, so that it is possible to press the impermeable drying band at an arbitrary pressure and to easily replace the impermeable band. Accordingly, the working efficiency is advantageously improved.

Also, anterior to the contact of the porous web with the heating cylinder, the surface on the side having no contact with the heating cylinder of the porous web may be brought into contact with a permeable drying band permeable to air and water, whereas upon the contact with the heating cylinder, the surface on the side having no contact with the porous web of the permeable drying band may be brought into contact with the impermeable drying band from a predetermined position on the heating cylinder onward.

Thus, according to the continuous drying apparatus for porous web of the present invention, after the porous web having been subjected to contact with the permeable drying band and to heating, the surface of the porous web is brought into contact with the impermeable drying band and cooled, with the result that it is possible to effectively remove water contained within the porous web, contributing to an improvement of the performance of the apparatus.

Also, at a position anterior to the contact of the porous web with the impermeable drying band there may be disposed an air exclusion mechanism for excluding air within the permeable drying band and the porous web.

Thus, according to the continuous drying apparatus of the present invention, the air exclusion mechanism is provided on the heating cylinder anterior to the contact of the porous web with the impermeable drying band, so that it is possible to suck the water within the porous web without remarkably reducing the pressure of the air exclusion mechanism, thereby achieving a significant reduction of the power consumption required by the apparatus.

A conveyance roll may also be provided for conveying the impermeable drying band, the surface of the conveyance roll being formed with an antislip finish.

Thus, according to the continuous drying apparatus for porous web of the present invention, a groove is formed in the surface of the conveyance roll for conveying the impermeable drying band so that water ejected from the shoes can be easily discharged, thereby achieving a steady running of the impermeable band without causing any slip even when it runs at a high speed.

A plurality of heating medium flow passages may also be formed in the interior of the heating cylinder in the vicinity of its surface.

An induction heating coil may further be provided externally in the vicinity of the surface of the heating cylinder.

Thus, according to the continuous drying apparatus for porous web of the present invention, the porous web running on the heating cylinder is pressed by the plurality of water lubricating shoe members so that the impermeable drying band can be pressed by an arbitrary pressure and that the replacement of the impermeable drying band can easily be carried out. It is therefore possible to improve the working efficiency.

DESCRIPTION OF THE PREFERRED EMBODIMENTS

(a) Description of An Embodiment of the Invention

An embodiment of the present invention will now be described with reference to the accompanying drawings.

Figure 1:
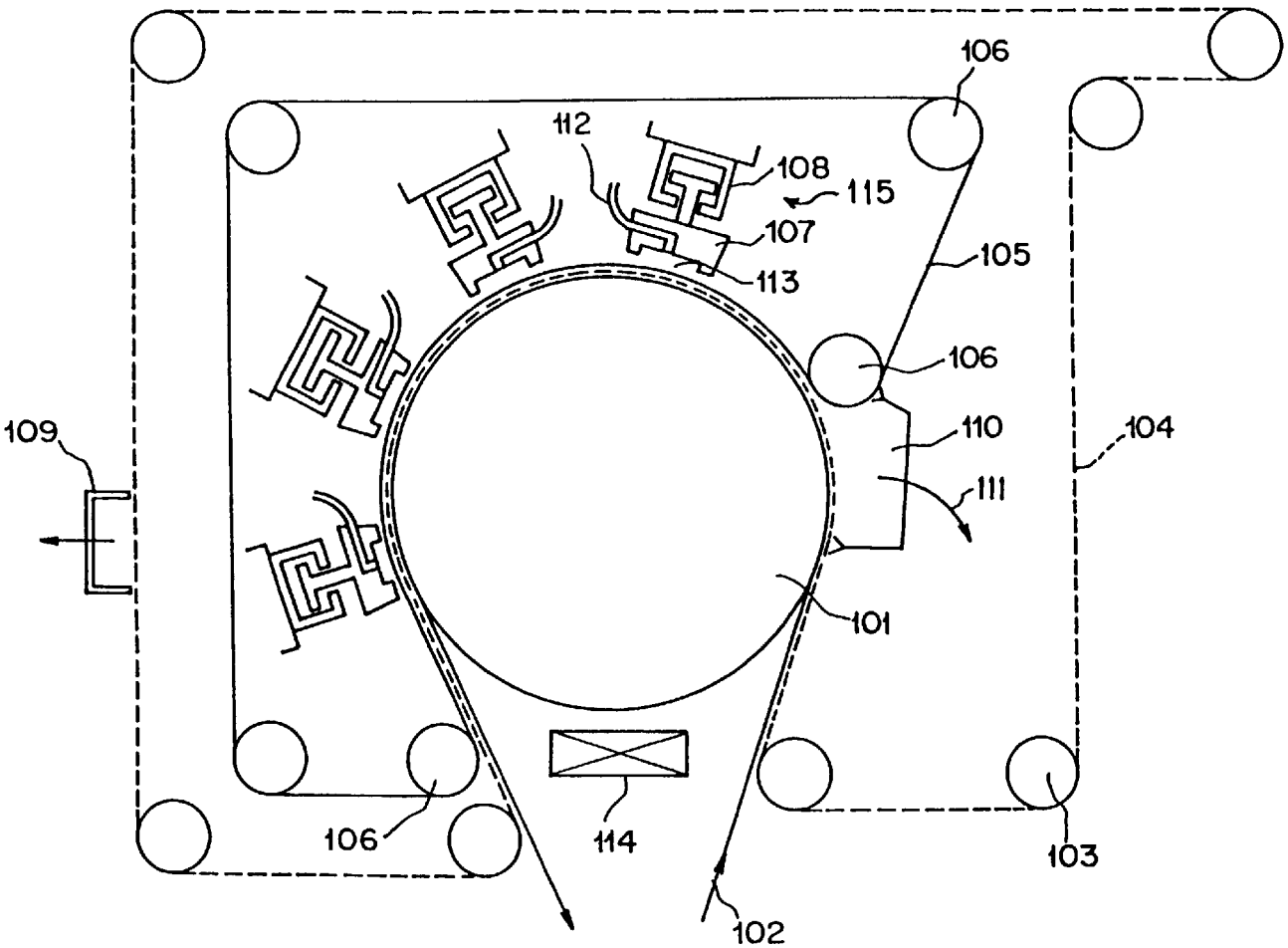
FIG. 1 is a schematic diagram showing a construction of a continuous drying apparatus for porous web in accordance with an embodiment of the present invention.
Figure 2:
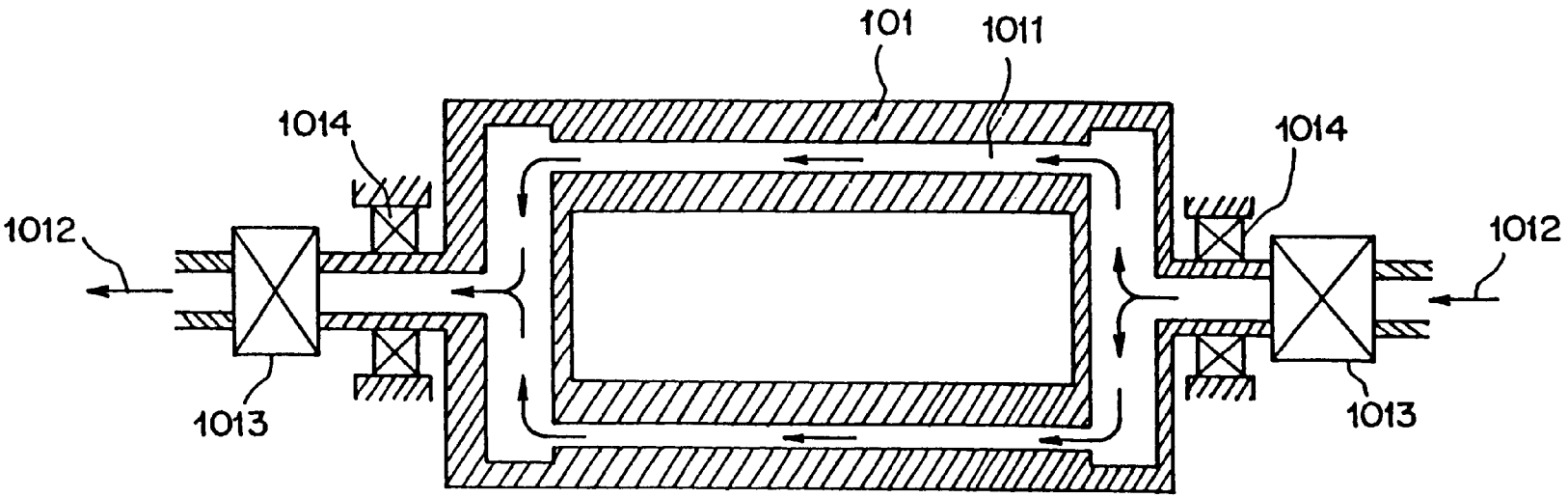
FIG. 2 is a horizontal sectional view showing a principal part of the continuous drying apparatus for porous web in accordance with the embodiment of the present invention.
Figure 3:
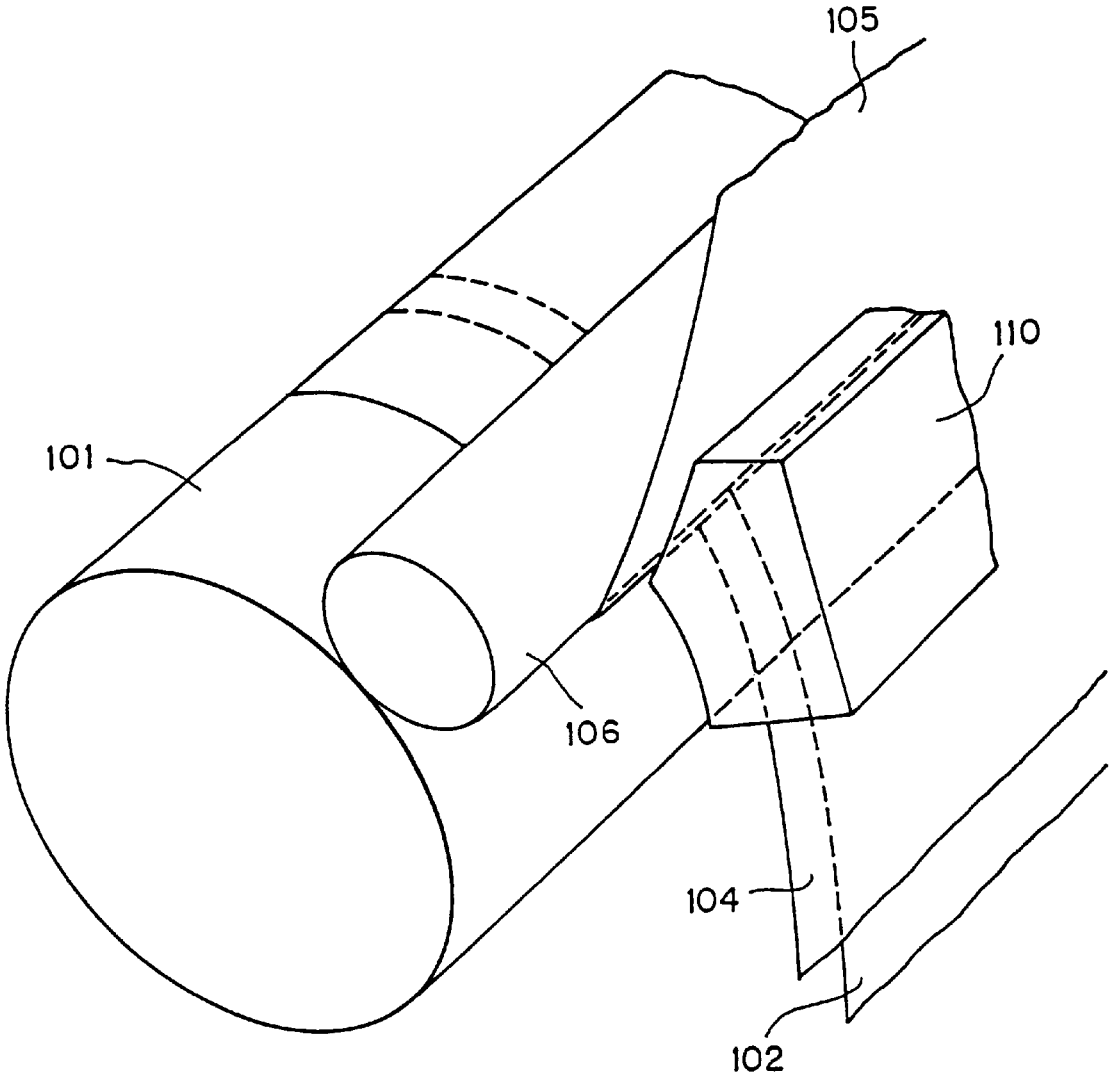
FIG. 3 is a isometric view showing a principal part of the continuous drying apparatus for porous web in accordance with the embodiment of the present invention.
Figure 4:
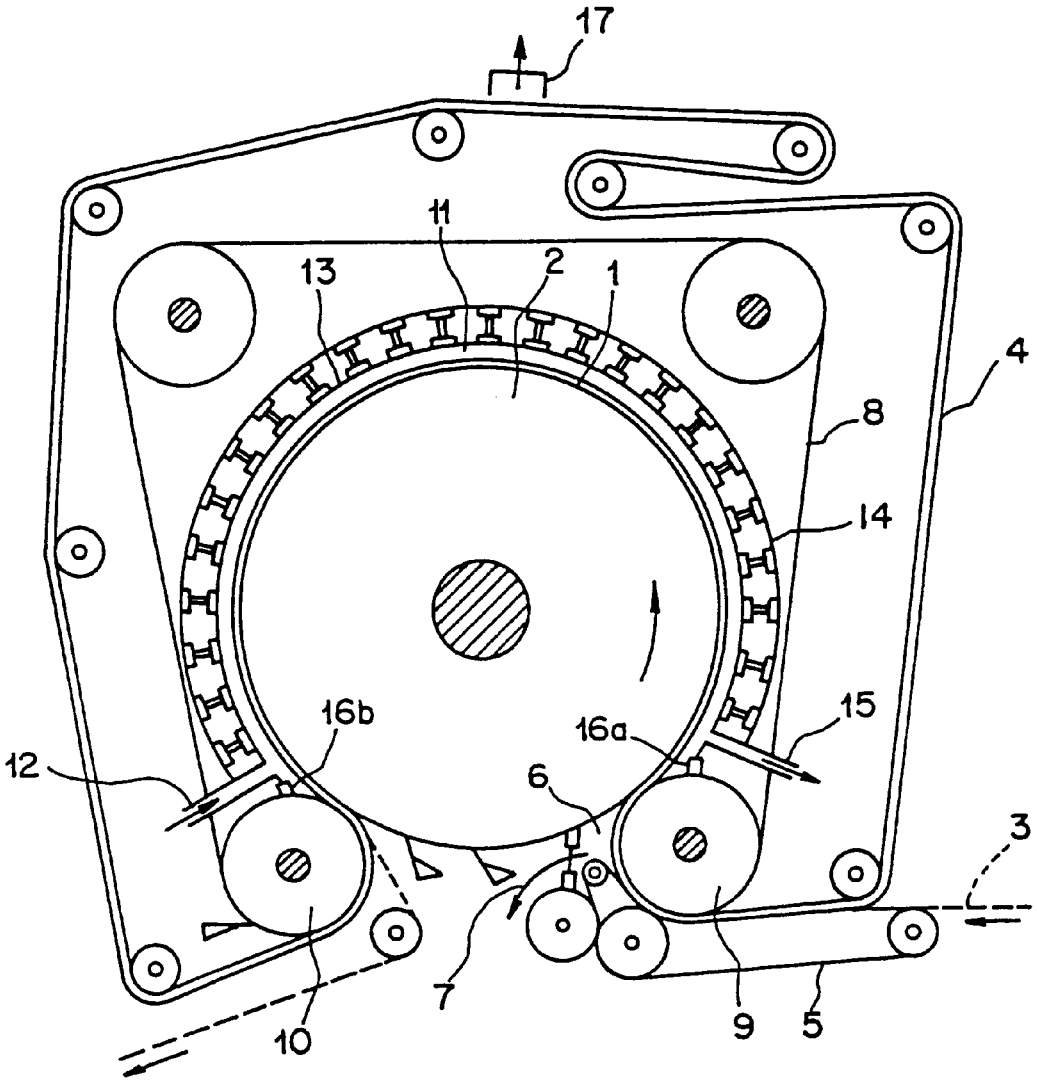
FIG. 4 is a schematic diagram showing a conventional continuous drying apparatus for porous web.
Figure 5:
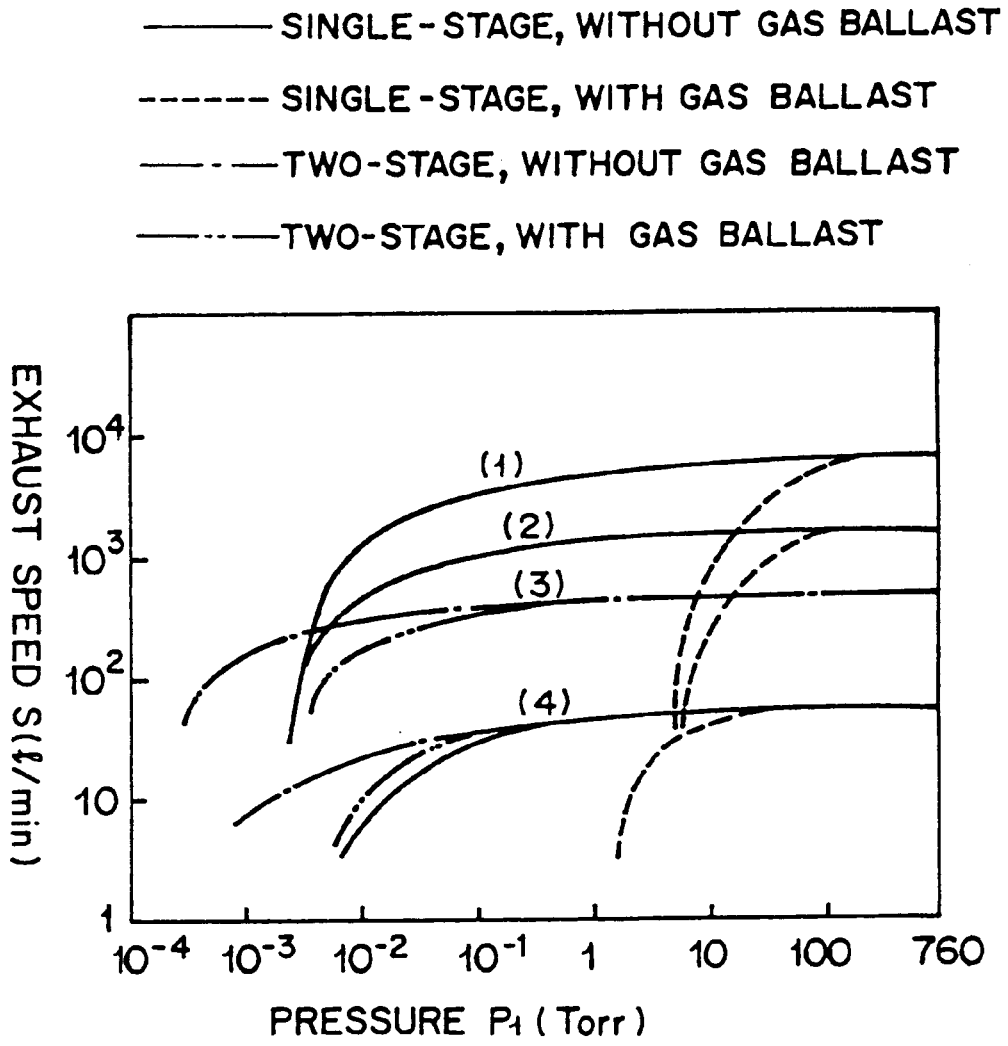
FIG. 5 is a diagram showing an exhaust characteristic of an oil-sealed rotary vacuum pump.
Figure 6:
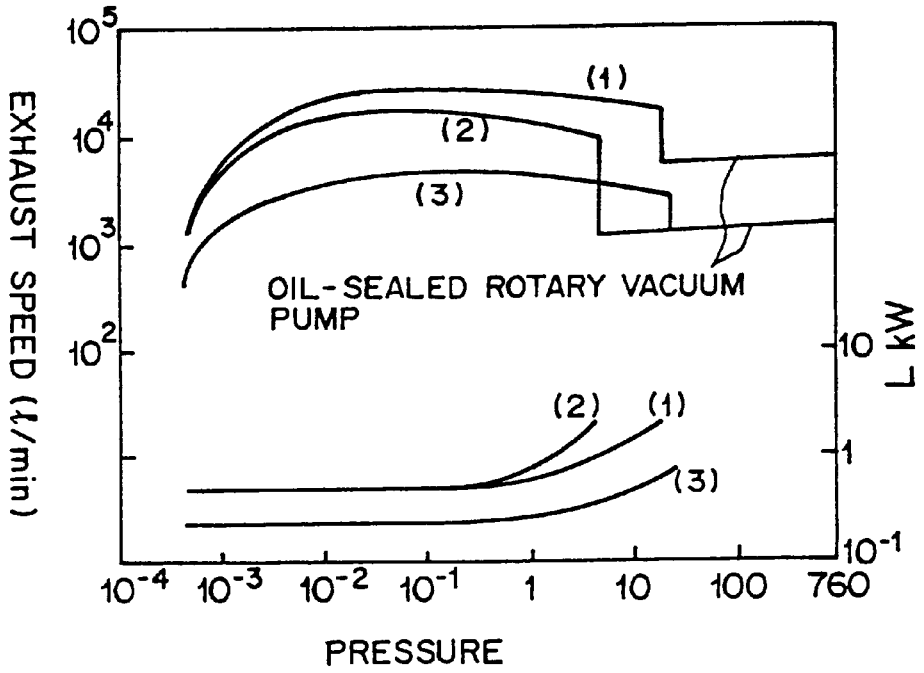
FIG. 6 is a diagram showing an exhaust characteristic of a mechanical booster.
Figure 7:
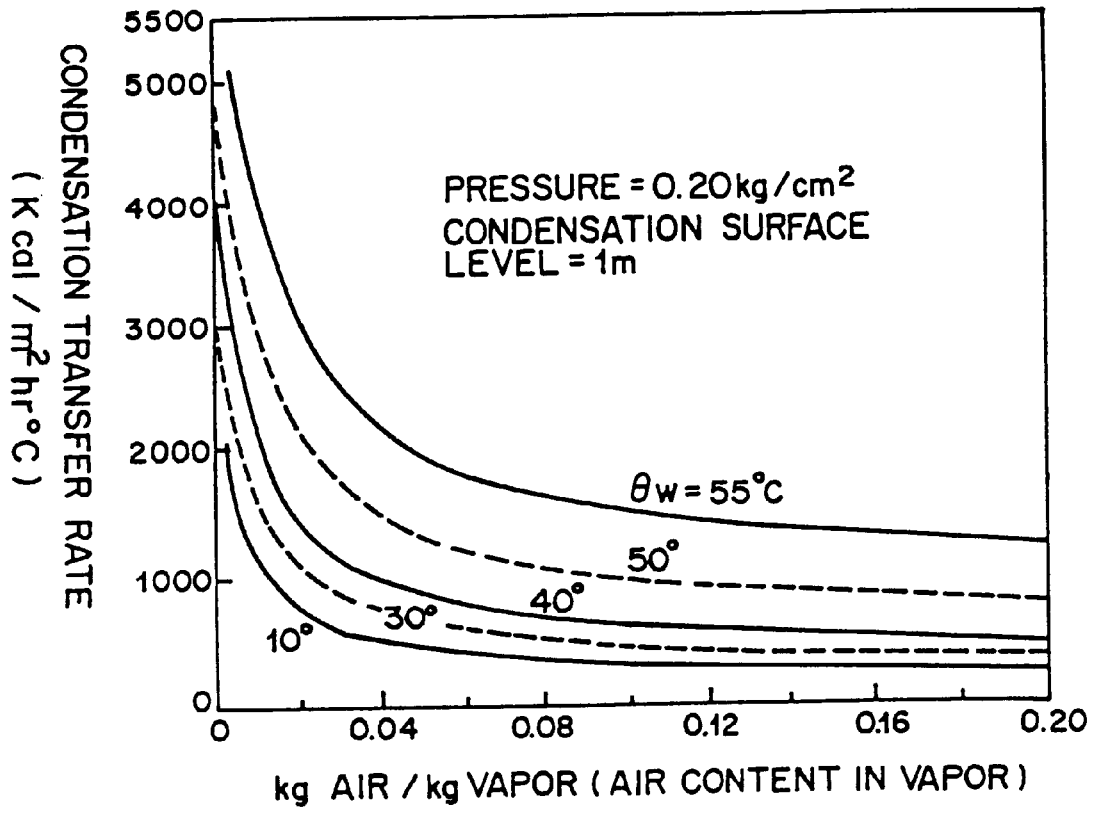
FIG. 7 is a diagram showing the influence of non-condensed gas within vapor on the condensation heat conduction.

FIGS. 1 to 3 illustrate a construction of a continuous drying apparatus for porous web which is an embodiment of the present invention. FIG. 1 is a schematic diagram showing the construction thereof, FIG. 2 is a horizontal sectional view showing a principal part thereof and FIG. 3 is a isometric view showing the principal part thereof.

By the way, the continuous drying apparatus for porous web (the concept of the porous web includes not only paper but also sheet or the like) in accordance with the present invention comprises as shown in FIG. 1 a plurality of water lubricant shoes 115 arranged on a heating cylinder (a heating surface element) 101, and an air eliminating chamber disposed upstream of the water lubricant shoes 115 for eliminating air contained in the porous web 102 running along a conveyance line (which may hereinafter be referred to simply as a line) on the heat cylinder 101, with the arrangement such that a drying band 104 having water and air permeability is brought into contact with the surface on the side having no contact with the heating cylinder 101 of the porous web 102 running along the line on the heating cylinder 101, on which is superposed a cooling surface element 105 having no water and air permeability in a contact supporting manner, to thereby dry the porous web 102. The constructions of the parts and their vicinities will be described in detail hereinbelow.

In this case, the heating cylinder 101 has a peripheral surface coming into contact with the porous web 102 to heat the porous web 102, and as shown in FIG. 2 for example it is a hollow cylinder provided internally with a plurality of heating medium flow passages 1011 in the vicinity of its surface. A heating medium (for example, Therm S series supplied by Shin-nittetu Kagaku Kabushiki Kaisha), which is supplied and discharged through a rotary joint 1013, flows through the heating medium flow passages 1011 to heat the heating cylinder 101. Besides, the heating cylinder 101 is supported for rotation by a bearing 1014.

Although the above heating cylinder 101 is intended to be heated by the heating medium 1012 within the heating medium flow passages 1011 formed in the interior in the vicinity of its surface, it may be heated by an induction heating coil 114 (see FIG. 1) externally disposed at a part in the vicinity of the peripheral surface of the heating cylinder 101. It is to be appreciated that in this case either of them may be provided for heating or alternatively both of them may be provided to allow either of them to be used as auxiliary heating, and that the advantageous method can freely be selected depending on the heating and other conditions.

Furthermore, the drying band (permeable drying band) 104 comes to contact with and supports the surface on the side having no contact with the heating cylinder 101 of the porous web 102. The drying band 104 is made so as to allow air and water to permeate therethrough (for example, made of a porous material) and runs along an endless line conveyed by conveyance rolls (drying band conveyance rolls) 103.

Then, the drying band 104 absorbs water contained in the porous web 102 while running along the endless line, with the water stored by absorption being removed by a suction box 109 provided at a part on the endless line.

It is to be noted that the width of the drying band 104 (the distance in the direction orthogonal to the line) is larger than the width of the porous web 102 as shown in FIG. 3 for instance. This is due to the fact that in addition to the necessity to dry the porous web 102 uniformly in the width direction, the drying band 104 may meander to a certain extent together with the porous web 102. By making the width of the drying band 104 larger than the width of the porous web 102 in this manner, a secure drying of the porous web 102 is achieved.

Also, an air removal chamber (an air exclusion mechanism) 110 is provided for excluding air 111 within the drying band 104 and the porous web 102. The vapor (air and water) flowing out of the porous web 102 as a result of evaporation is heated through the contact with the heating cylinder 101 and is sucked by a suction pump (not shown) of the air removal chamber 110.

That is, by being heated by the heating cylinder 101, the porous web 102 is caused to have a higher vapor pressure (and hence, the ejection is effected with a vapor pressure exceeding the atmospheric pressure) so that the air partial pressure within the porous web 102 is lowered, with the result that a higher drying performance can be obtained (more specifically, at of the order of 660 Torr) without remarkably reducing the pressure (to 1 Torr) within the air removal chamber 110 as in the prior art.

Incidentally, since the pressure within the air removal chamber 110 is equal to the pressure within the suction box 109 positioned on the drying band 104, a water sealing pump for instance is used as the suction pump to suck the air 111.

Also, the air removal chamber 110 is disposed at a position anterior to the contact of the porous web 102 with the cooling surface element 105, in other words, at a region (a closed space) where the drying band 104 is exposed on the heating cylinder 101.

More specifically, as shown in FIG. 3, the air removal chamber 110 is provided so as to have a width smaller than the width (the distance in the direction orthogonal to the line) of the cooling surface element 105 running along the line, thereby preventing lubricating water from the water lubricating shoes 115 which is to be described later from entering the air removal chamber 110.

Also, the cooling surface element (impermeable drying band) 105 comes into contact with and supports the surface on the side having no contact with the heating cylinder 101 of the porous web 102. The cooling surface element 105 is made to be impermeable to air and water and runs along the endless line by means of grooved conveyance rolls (grooved cooling surface conveyance rolls) 106. Then, it cools the fed porous web 102 while running along the endless line. Besides, the grooved conveyance roll 106 is described later.

More specifically, previous to the contact of the porous web 102 with the heating cylinder 101 the drying band 104 is brought into contact with the surface on the side having no contact with the heating cylinder 101 of the porous web 102, and after the contact of the porous web 102 with the heating cylinder 101 the cooling surface element 105 is brought into contact with the surface on the side having no contact with the porous web 102 of the drying band 104 at a predetermined position on the heating cylinder 101 (downstream of the air removal chamber 110) onward.

Thus, description will then be made of a cooling effect of the cooling surface element 105. In order to press the porous web 102 to be dried against the heating cylinder 101, the vapor must be processed within a closed space. In case the porous web 102 is not cooled by the cooling surface element 105, the pressure within the closed space will rise up to a vapor pressure corresponding to the temperature of the heating cylinder 101, preventing water within the porous web 102 from vaporing. That is, in order to obviate this, a specified cooling surface such as the cooling surface element 105 is formed so that the vapor contained in the porous web 102 is condensed for removal.

Also, the plurality of water lubricating shoes (water lubricating shoe members) 115 are arranged around the heating cylinder 101 with a given gap relative to the outer side of the cooling surface element 105. Each water lubricating shoe 115 as shown in FIG. 1 for example consists of a shoe 107 for forming a water screen flow, which may also be called "water film flow", between it and the outer surface of the cooling surface element 105, and a hydraulic cylinder (a hydraulic apparatus) 108 for pressurizing the shoe 107 toward the heating cylinder 101 by way of the water screen flow. That is, each shoe is not allowed to come into direct contact with the drying band 104 (due to the presence of the water screen).

More specifically, this water lubricating shoe 115 forms a water screen within a pressure space 113 defined between the shoe 107 and the cooling surface element 105 using lubricating water supplied from a water supply port 112 provided in the shoe 107 so that the cooling surface element 105 is pressed via water screen, which may also hereinafter be called "water film", within the pressure space 113 by the hydraulic cylinder 108.

Also, the water pressure within the shoe 107 is a pressure equal to a pressure loss within the flow passage in the form of a minute gap defined between the shoe 107 and the cooling surface element 105, with the porous web 102 being urged against the pressure cylinder 101 by this pressure. That is, it is possible to press the cooling surface element 105 with an arbitrary pressure by the hydraulic cylinder 108.

Incidentally, the water supplied to the shoe 107 is used to cool the cooling surface element 105 in addition to the use for the application of pressure, the used water being discharged around from the gap between the shoe 107 and the cooling surface element 105. Then, the thus ejected water is recovered for recirculation.

Also, upon the replacement of the cooling surface element 105, the shoe 107 is moved radially away from the pressure cylinder 101 by use of the hydraulic cylinder 108 to thereby effect an easy replacement.

By the way, the cooling surface element 105 being conveyed by the grooved conveyance rolls 106 as described above, the surfaces of the grooved conveyance rolls 106 are formed with antislip finish. More specifically, the surface of each roll is provided with a groove into which flows the water ejected from the water lubricating shoe 107.

Then, the water which has flowed into the groove is shaken away by the centrifugal force or discharged with the adhesion to the cooling surface element 105. It is to be appreciated that the groove in the surface of the roll could be formed in any various forms, for instance, it may extend in the direction along the periphery of the roll or in the direction intersecting this direction.

That is, water is retained within the groove in the surface of the roll at the region where the grooved conveyance roll 106 and the cooling surface element 105 are in contact with each other, allowing a direct contact between the surfaces except the groove of the roll and the cooling surface element 105 with no water screen, to thereby achieve a stable running of the cooling surface element 105 on the grooved conveyance roll 106 without causing any slip even in case of high-speed running.

Although description has been made in detail hereinabove of the grooved conveyance roll 106 having a roll surface formed with a groove, the roll surface may be simply roughened instead of such a groove. In this case also, an easy discharge of water is achieved. Furthermore, the formation of the groove or the roughening of the surface ensures not only the easy water discharge but also the increase of friction of the roll surface against the cooling surface element 105, which leads to an increased antislip effect.

In the continuous drying apparatus for porous web in accordance with an embodiment of the present invention having the above construction, as shown in FIG. 1, the drying band 104 is brought into contact with the surface on the side having no contact with the heating cylinder 101 of the porous web 102 to be dried before the porous web 102 comes into contact with the heating cylinder 101, so that when the porous web 102 in contact with the drying band 104 comes into contact with the heating cylinder 101, it is heated by the heating cylinder 101.

Afterwards, the porous web 102 is heated so that water within the porous web 102 evaporates at a vapor pressure exceeding the atmospheric pressure with the result that the air 111 (air, vapor, etc., within the drying band 104 and the porous web 102) is sucked by the air chamber 110.

Subsequently, the porous web 102 from which vapor and air has been sucked by the air chamber 110 are conveyed on the heating cylinder 101 downstream of the air chamber 110 in such a manner that the cooling surface element 105 is in contact with the surface on the side having no contact with the porous web 102 of the drying band 104.

At that time, the porous web 102 is pressed and cooled via the cooling surface element 105 by means of lubricating water from the shoes 107, so that water within the porous web 102 condenses and is absorbed by the drying band 104 for transfer. Besides, the thus absorbed water is removed by the suction box 109 positioned on the conveyance line of the drying band 104.

In this manner, according to the continuous drying apparatus for porous web which is an embodiment of the present invention, the porous web 102 running on the conveyance line on the heating cylinder 101 is pressed by the plurality of shoes 115 against the heating cylinder 101, so that the cooling surface element 105 can be pressed at an arbitrary pressure and that the replacement of the cooling surface element 105 is easy to perform. Thus, the working efficiency can be advantageously improved.

Also, after the porous web 102 has been brought into contact with the drying band 104 and heated, the porous web 102 is cooled by the cooling surface element 105 coming into contact with the surface on the side having no contact with the porous web 102 of the drying band 104, so that an effective removal of water within the porous web 102 is achieved, contributing to an improvement in the performance of the apparatus.

Furthermore, the air removal chamber 110 is provided on the heating cylinder 101 and anterior to that the cooling surface element 105 contacts with the drying band 104, so that water within the porous web 102 can be sucked without significantly reducing the pressure within the air removal chamber 110, thereby making it possible to remarkably curtail the power consumption taken by the apparatus.

The groove is also provided in the surfaces of the conveyance rolls 106 for the conveyance of the cooling surface element 105, so that it is possible to easily discharge the water ejected from the shoes 107, achieving a stable running of the cooling surface element 105 without any slip even when it runs at a high speed.

It is to be appreciated that the present invention is not intended to be limited to the above embodiments, and that it could be variously embodied without departing from the spirit of the present invention.

What is claimed is:

1. A continuous drying apparatus for a porous web having a first side and a second side comprising:

a heating cylinder having a peripheral surface adapted to be brought into contact only with the first side of the porous web for heating the porous web;

a cooling surface element impermeable to air and water, supporting the porous web on the second side out of contact with peripheral surface of said heating cylinder; and a plurality of shoe members arranged around said heating cylinder apart a desired distance from the external surface of said cooling surface element, for forming a water film flow, which is used to cool and press the porous web, between said shoe members and the external surface of said cooling surface element.

2. A continuous drying apparatus for a porous web according to claim 1, wherein each of said shoe members includes a shoe for forming a water film flow, which is used to cool and press the porous web, between each said shoe and the external surface of said cooling surface element, and a hydraulic apparatus for pressing each said shoe via said water film flow against said heating cylinder.

3. A continuous drying apparatus for a porous web according to claim 1, wherein:

before the porous web comes into contact with said heating cylinder, the second side of the porous web is brought into contact with a permeable drying band permeable to air and water; and when the porous web has come into contact with said heating cylinder, said permeable drying band, at one of opposite surfaces which is out of contact with the porous web, is brought into contact with said cooling surface element from a predetermined position on said heating cylinder.

4. A continuous drying apparatus for a porous web according to claim 3, further comprising an air exclusion mechanism for excluding air within said permeable drying band and the porous web before the porous web comes into contact with said cooling surface element.

5. A continuous drying apparatus for a porous web according to claim 1, further comprising a conveyance roll for conveying said cooling surface element, said conveyance roll having a surface treated with an antislip finish.

6. A continuous drying apparatus for a porous web according to claim 1, wherein said heating cylinder includes a plurality of heating medium flow passages formed internally in the vicinity of its surface.

7. A continuous drying apparatus for a porous web according to claim 1, further comprising an induction heating coil disposed externally in the vicinity of the surface of said heating cylinder.

8. A continuous drying apparatus for a porous web having a first side and a second side comprising:

a heating cylinder having a peripheral surface for contacting the first side of the porous web and for heating the porous web being conveyed over the peripheral surface;

a permeable drying band permeable to air and water, which is conveyed over the porous web coming into contact with, and supporting the second side of the porous web;

a cooling surface element to be conveyed over the permeable drying band on a side of the permeable drying band which does not contact the porous web; and a plurality of shoe members arranged in an arcuate path around said heating cylinder apart a desired distance from the external surface of said cooling surface element, for forming a water film flow, which is used to cool and press the porous web, between said shoe members and the external surface of said cooling surface element;

said heating cylinder, said permeable drying band, said cooling surface element and said shoe members serving to act on the porous web to remove liquid therefrom.

* * * * *